United States Patent [19]

Tsuji et al.

[11] 4,076,887

[45] Feb. 28, 1978

[54] RECORDING SHEETS

[75] Inventors: Nobuo Tsuji; Sadao Ishige; Akio Miyamoto; Hajime Kato, all of Minami-ashigara, Japan

[73] Assignee: Fuji Photo Film Co., Ltd., Minami-ashigara, Japan

[21] Appl. No.: 736,669

[22] Filed: Oct. 28, 1976

[30] Foreign Application Priority Data

Oct. 28, 1975 Japan ..... 50-130079

[51] Int. Cl.[2] ..... B41M 5/12; B41C 1/06

[52] U.S. Cl. ..... 428/307; 282/27.5; 427/150; 427/152; 428/411

[58] Field of Search ..... 427/144–146, 427/150–152; 428/411, 913, 307; 282/27.5

[56] References Cited

U.S. PATENT DOCUMENTS

| | | | |
|---|---|---|---|
| 3,244,548 | 4/1966 | Sullivan | 427/145 X |
| 3,856,553 | 12/1974 | Hayashi et al. | 427/150 X |
| 3,912,831 | 10/1975 | Kan et al. | 428/411 X |
| 3,937,864 | 2/1976 | Kohmura et al. | 427/150 X |
| 3,996,405 | 12/1976 | Porter | 427/150 |

*Primary Examiner*—Harold Ansher

*Attorney, Agent, or Firm*—Sughrue, Rothwell, Mion, Zinn and Macpeak

[57] ABSTRACT

A recording sheet comprising a support and a developer layer, which develops color images on reacting with a color former, on the support containing a dimer of the compound represented by the formula:

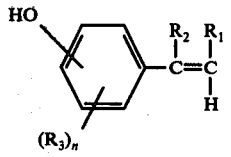

wherein $R_1$, $R_2$ and $R_3$ each represents a hydrogen atom, an alkyl group, an aryl group, or an aralkyl group, and $n$ is 1 to 4.

9 Claims, No Drawings

RECORDING SHEETS

BACKGROUND OF THE INVENTION

1. Field of the Invention

The present invention relates to recording sheets, more particularly, to recording sheets which develop color images on reacting with color formers.

2. Description of the Prior Art

Recording sheets utilizing the coloring reaction between an almost colorless basic dye precursor (hereinafter referred to as a "color former") and an adsorptive or acid reactive compound developing color on reacting with the color former (hereinafter referred to as a "developer"), such as clay materials, e.g., acid clay, activated clay, attapulgite, zeolite, bentonite, kaolin, etc.; organic acids, e.g., succinic acid, tannic acid, gallic acid, alkyl-substituted phenols, bisphenol A, etc.; metal salts of aromatic carboxylic acids, e.g., zinc, aluminum or like metal salts of alkyl-substituted salicyclic acids; and acid polymers, e.g., p-phenylphenol-formaldehyde resins, etc., are generally well known. The term "color former" herein designates those materials developing color on donating an electron or receiving a proton from an acid, etc., and the term "developer" designates those materials which receive an electron or donate a proton.

Recording sheets practically utilizing the above phenomenon include pressure-sensitive copying papers as described in U.S. Pat. Nos. 2,505,470, 2,505,489, 2,550,471, 2,548,366, 2,712,507, 2,730,456, 2,730,457, 3,418,250, etc., and heat-sensitive papers as described in Japanese Patent Publication 4160/1968, U.S. Pat. No. 2,939,009, etc. In addition, there is known a printing method in which a color image is obtained by feeding ink containing a color former through a medium such as a stencil onto a sheet with a developer coated thereon, as is described in German Patent Application (OLS) 1,939,624.

Recording utilizing the above phenomenon requires a physical action, for instance, the application of pressure by means of a ballpoint pen, a typewriter, etc., or the application of heat by means of a heating element, electricity, etc.

A pressure-sensitive copying paper is most typical of the recording sheets. A pressure-sensitive copying paper is obtained by dissolving a color former in a solvent, e.g., alkylated naphthalene, alkylated diphenyl methane, an alkylated diphenyl or, ter-phenyl, chlorinated paraffin, etc., dispersing the resulting solution in a binder or encapsulating it, and then coating the dispersion or capsules on a support, e.g., paper, a plastic sheet, a resin coated paper, etc. On the other hand, where the developer is dissolved in a solvent, e.g., an organic solvent, the support is dipped in the resulting developer solution and impregnated with the same. Alternatively, the developer is dissolved or dispersed in a medium together with a binder, and coated on the support. In general, the color former and developer are coated on the same side or opposite sides of the support, or on the surfaces of different supports.

While these developer-coated sheets have many advantages, they still have several points to be improved.

For instance, where a clay material such as an activated clay or the like is used as a developer, a color image of Crystal Violet (for example) disappears by the action of a polar solvent, e.g., water and glycols. Where a phenol resin such as a p-phenylphenol-formaldehyde resin is used as a developer, the developer surface tends to turn yellow under light. In this case, aldehydes such as formaldehyde and the like are used in synthesizing the phenol resin, and the use of such formaldehyde and the like which are toxic is undesirable. Also, where a phenol compound, such as an alkyl-substituted phenol, bisphenol A or the like, is used as a developer, problems also occur, for example, a gradual reduction in developing capability, which is considered to be due to diffusion with time of these compounds or the diffusion thereof into the support. In addition, in the case of these alkyl-substituted phenols, bisphenol A, and the like, the initial developing capability is undesirably low.

These defects should be improved since they have a very bad influence on product value.

SUMMARY OF THE INVENTION

One object of the present invention is to provide a color image with polar solvent resistance.

Another object of the present invention is to reduce the yellow coloration of a developer surface.

A further object of the present invention is to prevent a reduction in developing capability due to the passage of time.

Still another object of the present invention is to increase developing capability.

A still further object of the present invention is to produce a recording sheet meeting the above requirements.

These objects are attained by using, as a developer, a dimer of the compound represented by the formula (I) shown below:

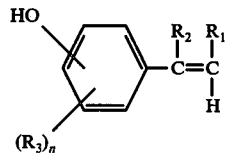

(I)

wherein $R_1$, $R_2$ and $R_3$ each represents a hydrogen atom, an alkyl group (preferably containing 1 to 30 carbon atoms, more preferably 1 to 18 carbon atoms), an aryl group (e.g., phenyl, naphthyl), which may be unsubstituted or substituted with an alkyl group (preferably having 1 to 30 carbon atoms, more preferably 1 to 18 carbon atoms) or a halogen atom (e.g., chlorine, bromine or iodine) or an aralkyl group (e.g., where the aryl moiety is phenyl or naphthyl and the alkyl moiety preferably has 1 to 30 carbon atoms, more preferably 1 to 18 carbon atoms), $n$ is 1 to 4, and the OH group may be present at either the meta-position or the para-position relative to the

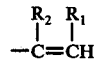

moiety, the para-position being preferred.

DETAILED DESCRIPTION OF THE INVENTION

The present invention provides a recording sheet comprising a support, and a developer layer overlaid on the support and capable of developing a color image on reacting with a color former, wherein the developer layer contains as a developer a dimer of the compound represented by the formula (I).

The recording sheet of this invention has advantages in that disappearance of the colored substance due to the presence of a polar solvent does not occur, (e.g., a polar solvent such as water), a yellow coloration on irradiation with light, e.g., sunlight, is low, and the reduction in developing capability with the passage of time is small.

On method of synthesizing developers used in the present invention is as follows:

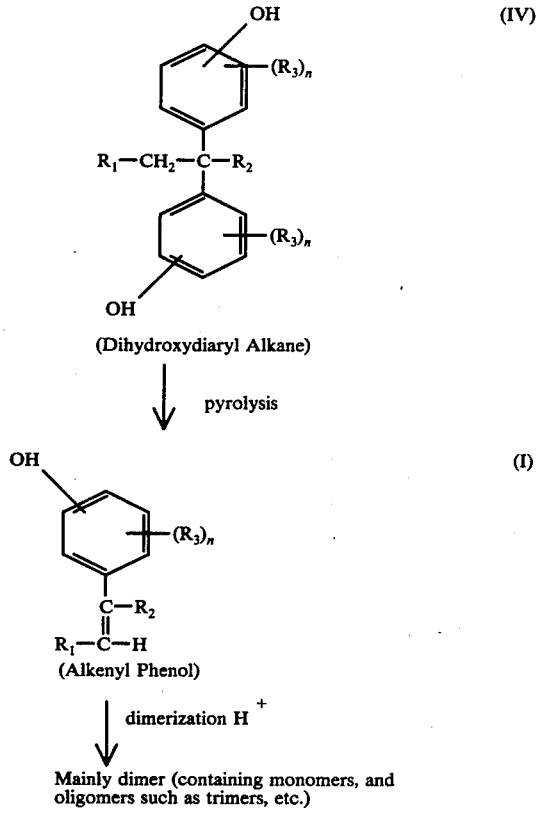

$R_1$, $R_2$, $R_3$ and $n$ are as described above.

The pyrolysis of the compound represented by formula (IV) is carried out in the presence of an oxide, hydroxide, alcoholate or phenolate of an alkali metal or an alkaline earth metal under anhydrous conditions.

The dimer of the compound represented by formula (I) is obtained by heating at least one compound of formula (I) at a temperature of 15° to 130° C in the presence of an acid catalyst.

In this way, the dimer of the present invention can be synthesized with safety and ease as compared to phenol resins.

The synthesis of the dimer of the present invention is described in greater detail in Japanese Patent Application (OPI) 30852/75, British Pat. No. 903,062 and German Patent 1,004,168.

Typical examples of the alkenyl phenols represented by formula (I) are p-isopropenyl phenol, 2-(p-hydroxyphenyl)-2-butene, 2-(p-hydroxyphenyl)-2-pentene, α-(p-hydroxyphenyl)-styrene, 1-(p-hydroxyphenyl)-1-isobutene, p-cyclohexenylphenol, 2-(p-hydroxyphenyl)-3-methyl-2-butene, 2-(p-hydroxyphenyl)-2-hexene, 2-(p-hydroxyphenyl)-2-hexadecene, m-methyl-p-isopropenylphenol, 2-(o-isopropyl-p-hydroxyphenyl)-2-butene, 2-(o-phenyl-p-hydroxyphenyl)-2-pentene, 2-(o-tert-butyl-p-hydroxyphenyl)-2-pentene, m-isopropenylphenol, 1-(p-hydroxyphenyl)-1-propylene, 2-(o-benzyl-p-hydroxyphenyl)-2-butene, 2-(o-phenethyl-p-hydroxyphenyl)-2-butene, etc.

In the synthesis of the dimer of the present invention, monomer and oligomers such as trimers, etc., in addition to the dimer, may be present. Such a mixture can be employed as the color developer of the present invention with the dimer being preferably present in amount of about 60% by weight or higher, more preferably 80% by weight or higher, with the trimer being preferably present in an amount of 20% by weight or less and the monomer being preferably present at most in an amount of about 5% by weight or less.

The recording sheet of the present invention is produced by coating a solution obtained by dissolving the developer (which may contain monomers and oligomers such as trimers, etc., in addition to dimers) in an organic solvent, to which a binder and an inorganic pigment may be added as desired or necessary, on a support or by impregnating the support with the above solution. In accordance with another method, the developer of the present invention is dispersed in water, and the resulting dispersion, to which a binder and an inorganic pigment, etc., may be added as desired or necessary, is coated on a support. In this case, the addition of silicone oil, octyl alcohol, etc., for the purposes of defoaming or inhibiting foaming, and the addition of a small amount of other additives as are conventionally used in the art do not interfere with the effect of the present invention. A suitable weight ratio of the binder to the solid contents (including dimer and pigment) preferably ranges from about 1:1 to 50:1 and more preferably 5:1 to 40:1 and a suitable weight ratio of the pigment to the dimer is preferably about 0.1:1 to 100:1, most preferably 0.5:1 to 50:1, and most preferably 1:1 to 10:1.

Additives which can be used in combination with the developer include oil-adsorbing inorganic pigments (clays, e.g., kaolin, talc, bentonite, acid clay, activated clay, agalmatolite, etc.; metal oxides, e.g., zinc oxide, titanium oxide, zeolite, etc.; silicic acid salts other than clays, e.g., anhydrous silicic acid, aluminum silicate, zinc silicate, etc., and the like), metal salts of aromatic carboxylic acids (for example, zinc 3,5-di-tert-butyl salicylate, zinc 3-cyclohexyl salicylate, and the like), phenol resins (for example, novolak type phenol-aldehyde polymers, and the like), etc.

These compounds are described in U.S. Pat. Nos. 2,972,547, 3,501,331, 3,554,781, 3,625,736, 3,619,238, 3,669,711, 3,427,180, 3,455,721, 3,516,845, 3,634,121, 3,672,935, 3,732,120, 3,856,553, 3,772,052, 3,934,070, 3,874,895, 3,864,299, etc.

In the case that the developer of the present invention is dissolved in an organic solvent, the following organic solvents are exemplary of those which can be used: alcohols such as methanol, ethanol, butanol, and the like; esters such as ethyl acetate, butyl acetate, ethyl lactate, n-butyl lactate, ethyl glycolate, n-butyl β-oxypropionate, isobutyl β-oxypropionate, isobutyl β-oxypropionate, n-propyl β-oxypropionate, methyl α-hydroxyisobutyrate, ethyl α-hydroxy-n-butyrate, and the like; ketones such as acetone, methyl ethyl ketone, methyl isobutyl ketone, and the like; hydrocarbons such as benzene, toluene, xylene, and the like; etc.

In this case, to increase the absorptivity of the developer organic solvent, inorganic pigments such as white carbon, talc, titanium oxide, calcium carbonate, calcium hydroxide, and the like can be added. Moreover, in this case, as binders, polymethyl methacrylate, polyacrylates, polyvinyl acetate, vinyl acetate-vinyl chloride copolymers, polyvinyl butyral, polystyrene, linear saturated polyester resins, ethyl cellulose, cellulose acetate, nitrocellulose, and the like are dissolved therewith, and the resulting solution is coated on a support such as paper, a plastic sheet, a resin coated paper, and the like. A suitable thickness of the support is preferably 10 to 500 $\mu$ and more preferably 20 to 200 $\mu$.

On the other hand, where the developer of the present invention is used as a water system, it is pulverized (e.g., preferably to a size of 0.1 to 100 $\mu$ and more preferably to a size of 1 to 100 $\mu$) and dispersed in water. Alternatively the developer is dissolved in a solvent immiscible with water, such as ethyl acetate, benzene, toluene, and the like in a proportion of 3 to 80% of the developer, based on the solvent weight, and then the resulting solution is suspended in water and coated. In this case, inorganic pigments such as white carbon, talc, kaolin, agalmatolite, titanium oxide, calcium carbonate, calcium hydroxide, and the like can be added thereto, and as binders, water-soluble natural polymers such as proteins, e.g., gelatin, albumin, casein, and the like, celluloses, e.g., carboxymethyl cellulose, hydroxyethyl cellulose, and the like, saccharose, e.g., agar, sodium alginate, carboxymethyl starch, gum arabic, and the like; water-soluble synthetic polymer compounds such as polyvinyl alcohol, polyvinyl pyrrolidone, polyacrylic acid, polyacrylamide, and the like; latexes such as acrylate copolymer latexes, vinyl acetate based latexes, styrene-butadiene copolymer latexes, and the like can be added thereto as desired. The composition so obtained is coated on a support such as paper, a plastic sheet, a resin coated sheet, etc.

In any coating composition, if used, the amount of the binder added is about 1 to about 50 parts, preferably 5 to 40 parts, and more particularly 10 to 30 parts, per 100 parts by weight of the solids content of the developer, inorganic pigment, and the like. Where the amount of the binder used is small, insufficient film strength is obtained, whereas an excess of the binder causes a reduction in developing capability, which is not desired from the viewpoint of cost.

On the other hand, the inorganic pigment is typically, when used, added in an amount of about 10 to about 10,000 parts by weight per 100 parts by weight of the developer, preferably 50 to 5,000 parts by weight, and more preferably 100 to 1,000 parts by weight.

Moreover, if desired, the developer of the present invention can be used in combination with conventional developers such as acid clay, activated clay, phenol-formaldehyde resins, metal salts of aromatic carboxylic acids and the like. Where conventional developers are employed with the developer of the present invention, a suitable weight ratio of the conventional developer to the developer of the present invention is 0:1 to 100:1 and preferably 1:1 to 20:1.

Coating of the coating composition of the present invention wherein an organic solvent is used as a medium is carried out by coating or printing methods such as flexo printing method, gravure printing method, etc., using a printing machine. On the other hand, with a water system coating solution, wherein water is used as a medium, the coating is applied by methods which are conventionally used in this art, such as air knife coating, roll coating, blade coating, size press coating, etc. The coating amount is as the amount of the developer, (dimer) about 0.1 to about 5 g/m$^2$, preferably 0.2 to 3 g/m$^2$, and especially preferably 0.3 to 2 g/m$^2$.

Below about 0.1 g/m$^2$ in coating amount, insufficient developing capability is obtained, while the upper limit is determined mainly by product economics rather than performance.

Color formers which react with the developer used in the recording sheet of the present invention are not especailly limited and any conventional color formers can be employed. Representative examples of these color formers are triarylmethane compounds such as 3,3-bis(p-dimethylaminophenyl)-6-dimethylaminophthalide, i.e., Crystal Violet Lactone, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazole-3-yl)-5-dimethylaminophthalide, 3,3-bis(2-phenylindol-3-yl)-5-dimethylaminophthalide, 3-p-dimethylaminophenyl-3-(1-methylpyrol-2-yl)-6-dimethyl-aminophthalide, and the like; diphenylmethane compounds such as 4,4'-bis-dimethylaminobenzhydrin benzyl ether, N-halo-(e.g., iodo-, chloro-, bromo-)phenyl-leucoauramine, N-2,4,5-trichlorophenyl leucoauramine, and the like; xanthene compounds such as Rhodamine B-anilinolactam, Rhodamine B-p-nitroanilinolactam, Rhodamine B-p-chloroanilinolactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro-2-methylfluoran, 7-diethylamino-2,2-dimethylfluoran, 7-diethylamino-3-acetylmethylaminofluoran, 7-diethylamino-3'-methylaminofluoran, 3,7-diethylaminofluoran, 7-diethylamino-3-dibenzylaminofluoran, 7-diethylamino-3-methylbenzylaminofluoran, 3-diethylamino-7-phenylamino-6-methylfluoran, 7-diethylamino-3-chloroethylmethylaminofluoran, 7-diethylamino-3-diethylaminofluoran, and the like; thiazine compounds such as benzoyl leuco methylene blue, p-nitrobenzoyl-leuco methylene blue, and the like; spiro compounds such as 3-methyl-spiro-dinaphthopyran, 3-ethyl-spiro-dinaphthopyran, 3,3'-dichloro-spiro-dinaphthopyran, 3-benzylspiro-dinaphthopyran, 3-methyl-naphtho-(3-methoxy-benzo)-spiro-pyran, 3-propyl-spiro-dibenzopyran, and the like, and mixtures thereof. The developer of the present invention is effective particularly with triarylmethane compounds (e.g., triphenylmethane compounds) or thiazine compounds.

The color former is typically dissolved in a solvent and encapsulated, or dispersed in a binder solution, and then coated on a support. As the solvent used, natural or synthetic oils can be used singly or in combination with each other. Examples of the solvents are cotton seed oil, kerosene, paraffin, naphthene oil, alkylated biphenyls, alkylated terphenyls, chlorinated paraffins, alkylated naphthalenes, and the like.

For the encapsulation, a method utilizing the coacervation of a hydrophilic colloid sol as described in U.S. Pat. Nos. 2,800,457, 2,800,458, and the interfacial polymerization method as described in British Pat. Nos. 867,797, 950,443, 989,264, 1,091,076, etc., can be used.

The effect of the recording sheet of the present invention was confirmed using the following color former sheet.

Microcapsules containing the color former were produced by the method described in U.S. Pat. No. 2,800,457; the details thereof will be described below. Hereinafter all parts and percentages are by weight unless otherwide indicated.

Ten parts of acid-treated pigskin gelatin and 10 parts of gum arabic were dissolved in 400 parts of water at 40° C, and 0.2 part of Turkey red oil was added thereto. In the solution so prepared there was suspended and dispersed 40 parts of color former oil. This color former oil was 2% Crystal Violet lactone dissolved in diisopropyl naphthalene.

When the size of the droplet reached an average of 5 microns, the emulsification was stopped, and after water at 40° C was added to the emulsion to make 900 parts, stirring was continued. At this time, attention had to be taken so that the liquid temperature did not drop below 40° C. Then, 10% acetic acid was added to adjust the pH of the liquid to 4.0 – 4.2, whereupon coacervation was caused.

Stirring was further continued at 40° C, and, after 20 minutes, the liquid was cooled with ice water to gell a coacervate film deposited around the oil droplets.

When the liquid temperature reached 20° C, 7 parts of a 37% aqueous solution of formaldehyde was added thereto. At 10° C, a 15% aqueous solution of sodium hydroxide was added to adjust the pH to 9. The liquid was then heated over a period of 20 minutes (while stirring) so as to raise the temperature to 50° C.

The microcapsule dispersion so prepared was cooled to 30° C and then coated on paper of 40 g/m$^2$ in a coating amount (solids content) of 6 g/m$^2$ and dried.

In this way, a microcapsule sheet containing Crystal Violet lactone as a color former was obtained.

EXAMPLE 1

Ten parts of a dimer of p-isopropenylphenol synthesized in accordance with the method described in German Patent 1,004,168, and 3 parts of ethyl cellulose were dissolved in 50 parts of ethanol, and 20 parts of kaolin (average particle size: about 5 microns) was dispersed therein. The dispersion so prepared was coated on a base paper of 50 g/m$^2$ with a coating rod in an amount (solids content) of 5 g/m$^2$ and then dried; thus, a coated paper of the present invention was obtained.

On the thus obtained coated paper of the present invention was overlaid the capsule sheet containing Crystal Violet lactone described above, which was then pressed at 600 Kg/cm$^2$ to develop color. The color density after one day was measured with a spectrophotometer, and it was 0.72 at 610 m$\mu$. On exposing the coated surface to sunlight for 10 hours, almost no yellow coloration was observed.

For comparison, the same test was conducted using 2,2-bis(p-hydroxyphenyl)propane (bisphenol A) in place of the dimer of p-isopropenylphenol, and, in this case, the color density was only 0.35.

EXAMPLE 2

Forty parts of a dimer of 2-(p-hydroxyphenyl)-2-butene produced in the same manner as in Example 1, 6 parts of a naphthalenesulfonic acid-formaldehyde condensate, and 54 parts of water were ball milled for one day. Then, 100 parts of the dimer dispersion prepared above, 160 parts of kaolin, and 80 parts of a styrene-butadiene copolymer latex (solid content: 50%; carboxy content: 0.5 wt.%; styrene content: 50 wt.%; butadiene content: 49.5 wt.%) as a binder were added to 500 parts of water and mixed; thus, a coating solution of the present invention was obtained.

This coating solution was coated on a base paper of 50 g/m$^2$ in an amount (solids) of 6 g/m$^2$ with a coating rod, and dried.

The thus obtained coated paper of the present invention was subjected to the same test as in Example 1, and a color density of 0.78 was obtained. Furthermore, almost no yellow coloration due to sun light was observed.

For comparison, 2,2-bis(p-hydroxyphenyl)-butane was used in place of the dimer of the present invention, and, in this case, the color density was only 0.33.

EXAMPLE 3

Fifty parts of a dimer of 2-(p-hydroxyphenyl)-2-pentene (obtained in the same manner as in Example 1) and 5 parts of nitrocellulose were dissolved in 100 parts of toluene, and the resulting solution was coated on a base paper of 50 g/m$^2$ with a coating rod so that a solids content of 1.0 g/m$^2$ was coated, and then dried. Using the thus obtained coated paper of the present invention, the same test as in Example 1 was conducted. In this case, the color density was 0.65.

Furthermore, almost no yellow coloration due to sunlight was observed.

For comparison, 2,2-bis(p-hydroxyphenyl)-pentane was used in place of the dimer of the present invention, and in this case, the color density was only 0.24.

EXAMPLE 4

Using a dimer of m-methyl-p-isopropenylphenol (obtained in the same manner as in Example 1), a developer sheet of the present invention was obtained in the same manner as in Example 1, and, on effecting the same test as in Example 1, a color density of 0.78 was obtained.

Furthermore almost no yellow coloration due to sunlight was observed.

For comparison, 2,2-bis(m-methyl-p-hydroxyphenyl)-propane was used, and, in this case, the color density was only 0.34.

EXAMPLE 5

Using a dimer of 1-(p-hydroxyphenyl)-1-propylene (obtained in the same manner as in Example 1), a developer sheet of the present invention was obtained in the same manner as in Example 1, and, on effecting the same test as in Example 1, a color density of 0.73 was obtained. Furthermore almost no yellow coloration due to sunlight was observed.

For comparison, 1,1-bis(p-hydrophenyl)propane was used, and in this case, the color density was only 0.33.

EXAMPLE 6

Using a dimer of $\alpha$-(p-hydroxyphenyl)-styrene (obtained in the same manner as in Example 1), a developer sheet of the present invention was obtained in the same manner as in Example 2, and, on effecting the same test as in Example 1, a color density of 0.71 was obtained. Furthermore, almost no yellow coloration due to sunlight was observed.

For comparison, 1-phenyl-1,1-bis(p-hydroxyphenyl)-ethane was used, and, in this case, the color density was only 0.34.

EXAMPLE 7

Using a dimer of 2-(p-hydroxyphenyl)3-methyl-2-butene (obtained in the same manner as in Example 1), a developer sheet of the present invention was obtained in the same manner as in Example 2, and, on effecting the same test as in Example 1, a color density of 0.80 was obtained. Furthermore, almost no yellow coloration due to sunlight was observed.

For comparison, 2,2-(p-hydroxyphenyl)-3-methylbutane was used, and, in this case, the color density was only 0.38.

EXAMPLE 8

Using a dimer of 2-(p-hydroxyphenyl)-2-hexene obtained in the same manner as in Example 1, a developer sheet of the present invention was obtained in the same manner as in Example 2, and, on effecting the same test as in Example 1, a color density of 0.79 was obtained. Furthermore almost no yellow coloration due to sunlight was observed.

For comparison, 2,2-(p-hydroxyphenyl)-hexane was used, and, in this case, the color density was only 0.35.

From the above examples, it can be understood that the present invention provides excellent developer sheets.

While the invention has been described in detail and with reference to specific embodiments thereof, it will be apparent to one skilled in the art that various changes and modifications can be made therein without departing from the spirit and scope thereof.

What is claimed is:

1. A pressure-sensitive recording sheet comprising a support having a developer layer on the support, said developer layer being capable of developing color images on reacting with a color former, wherein the developer layer contains as a developer a dimer of the compound represented by the formula:

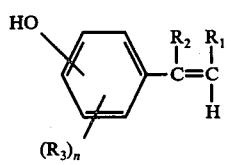

wherein $R_1$, $R_2$, and $R_3$ each represents a hydrogen atom, an alkyl group, an aryl group, or an aralkyl group, and $n$ is 1 to 4.

2. The recording sheet according to claim 1, wherein the alkyl group contains 1 to 30 carbon atoms.

3. The recording sheet according to claim 1, wherein the aralkyl group contains an alkyl moiety containing 1 to 30 carbon atoms.

4. The recording sheet according to claim 1, wherein the OH group is present at the meta-or para-position relative to the

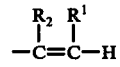

moiety.

5. The recording sheet according to claim 1, wherein $R_1$ is a hydrogen atom.

6. The recording sheet according to claim 1, wherein $R_2$ is an alkyl group.

7. The recording sheet according to claim 1, wherein said dimer is a dimer of the compound having the formula

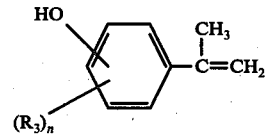

8. The recording sheet according to claim 1, wherein $R_3$ is a hydrogen atom.

9. The recording sheet according to claim 1, wherein said dimer is a dimer of the compound having the formula

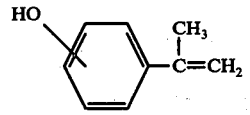

* * * * *